US010731463B2

(12) United States Patent
Roberts

(10) Patent No.: US 10,731,463 B2
(45) Date of Patent: Aug. 4, 2020

(54) ROCK BOLT

(71) Applicant: FCI Holdings Delaware, Inc., Wilmington, DE (US)

(72) Inventor: Trent Roberts, Smeaton Grange (AU)

(73) Assignee: FCI HOLDINGS DELAWARE, INC., Wilmington, DE (US)

( * ) Notice: Subject to any disclaimer, the term of this patent is extended or adjusted under 35 U.S.C. 154(b) by 0 days.

(21) Appl. No.: 16/336,196

(22) PCT Filed: Sep. 21, 2017

(86) PCT No.: PCT/IB2017/055715
§ 371 (c)(1),
(2) Date: Mar. 25, 2019

(87) PCT Pub. No.: WO2018/055536
PCT Pub. Date: Mar. 29, 2018

(65) Prior Publication Data

US 2019/0277138 A1 Sep. 12, 2019

(30) Foreign Application Priority Data

Sep. 26, 2016 (AU) ..... 2016101727

(51) Int. Cl.
*E21D 21/00* (2006.01)

(52) U.S. Cl.
CPC ..... *E21D 21/004* (2013.01); *E21D 21/00* (2013.01); *E21D 21/0033* (2013.01)

(58) Field of Classification Search
CPC ..... E21D 21/0033; E21D 21/004
See application file for complete search history.

(56) References Cited

U.S. PATENT DOCUMENTS 4,312,604 A 1/1982 Fu et al.
8,714,883 B2 5/2014 Rataj
(Continued)

FOREIGN PATENT DOCUMENTS

AU 2014215940 A1 3/2015
WO 2010104460 A1 9/2010
WO 2015189146 A2 12/2015

*Primary Examiner* — Carib A Oquendo
(74) *Attorney, Agent, or Firm* — The Webb Law Firm

(57) ABSTRACT

A rock bolt (10) is provided for frictionally engaging with the internal surface of a bore drilled into rockmass. The bolt comprises a tube having a circular cross-section (12) defining a longitudinal split (14) and a longitudinal axis (10*a*). The tube (12) in is radially expandable. The bolt (10) has a first leading end (12*b*) for insertion into a bore, a second end defining a head (12*a*) and expander means (30) for expanding the diameter of the tube at least one location along the tube. The expander means comprises first (42) and second (44) expander/wedge elements arranged so that relative movement of the two elements causes the diameter of the tube to expand at that location. The first expander element (42) is mounted on an elongate rod (30) which is aligned generally along the longitudinal axis of the tube. Rotation of the rod (30) causes the relative movement of the two elements to cause the diameter of the tube to expand at the location. The rock bolt includes an arrestor (100) in the form of a ring, which defines an aperture which locates on the proximal end of the rod (30). The aperture is larger than the proximal end of the rod so that the arrestor is able to move along the proximal end of the rod. The arrestor includes a laterally extending protrusion (102) which locates in the longitudinal split (14) and is narrower than the longitudinal split and which is configured to engage with the head of the friction bolt when moved towards the proximal end of the friction bolt.

6 Claims, 4 Drawing Sheets

(56) References Cited

U.S. PATENT DOCUMENTS

| | | | | |
|---|---|---|---|---|
| 8,894,329 | B1 * | 11/2014 | Kekahuna | F16B 13/066 405/259.3 |
| 9,797,249 | B2 | 10/2017 | Rataj et al. | |
| 10,370,968 | B2 * | 8/2019 | Rataj | E21D 21/0086 |
| 2016/0186564 | A1 * | 6/2016 | Evans | E21D 21/004 405/259.1 |

* cited by examiner

ROCK BOLT

CROSS-REFERENCE TO RELATED APPLICATIONS

This application is the United States national phase of International Application No. PCT/IB2017/055715 filed Sep. 21, 2017, and claims priority to Australian Innovation Patent No 2016101727 filed Sep. 26, 2016, the disclosures of which are hereby incorporated by reference in their entirety.

TECHNICAL FIELD

This invention relates to rock bolts, and in particular to friction bolts.

BACKGROUND

Rock bolts are used in rock strata for the purpose of stabilising the strata or rockmass. One type of rock bolt commonly used in hard rock mines is known as a friction bolt. This type of bolt comprises a tube, typically made of steel, that is split longitudinally and which is forced into a bore, drilled into rockmass which is marginally smaller than the diameter of the tube. The tube becomes compressed so that the external surface of the tube engages the internal surface of the bore, anchoring the rock bolt inside the bore by friction forces.

Friction bolts are relatively cheap to manufacture and are easy to use compared with some other types of rock bolts which often require resin or cement to lock them into the bore. However, friction bolts do have a number of drawbacks. One significant drawback is the tendency for friction bolts to disengage from the bore when a sufficiently large force is applied to the bolt.

It is known from U.S. Pat. No. 4,312,604, to weld lands inside the tube, to narrow the internal diameter of the tube at a specific location along the tube, and use oversized, wedge shaped inserts which engage with the lands to expand the tube at that location to provide better engagement of the bolt in the bore at that location. However, the added complexity of the tube of U.S. Pat. No. 4,312,604 increases manufacturing costs, particularly due to the additional components, and the additional step of welding the lands in the correct location inside the split tube.

Recently, more cost effective friction bolts have been developed and are becoming more common in Australian mines exemplified by the friction bolt shown in Australian patent application No 2014215940, by the applicant for the present application, which at least partly addresses the cost and complexity issues of U.S. Pat. No. 4,312,604, by using a floating arrangement for the expander wedges which avoids the need for welding, and thus reduces the manufacturing costs. Other manufacturers have developed their own proprietary rock bolt designs.

A typical friction bolt comprises a generally circular tube defining a longitudinal split, the tube being radially expandable, the bolt having a first leading end for insertion into a bore and a second end defining a head, and expander means for expanding the diameter of the tube at least one location along the tube. The expander elements typically comprising first and second wedge elements arranged so that relative movement of the two wedge elements causes the diameter of the tube to expand at that location. The first wedge element is mounted on a rod which extends along the tube towards the head of the bolt. The second wedge element locates between the rod and the tube. When the rod is rotated the wedge elements move together and cause the diameter of the tube to expand.

One unforeseen problem that has arisen with friction bolts is that in use, when deployed in mines they can become stretched under tension as the rockmass in which they are located can move and become compressed as the material around the strata is mined and removed. In some cases the tension in the rod is such that the rod fractures and fails in tension or shear. The broken rod will then eject from the hole at considerable velocity due to the energy stored in the rod which was under tension. While there are no known instances to date of any injuries caused by the broken rods, these failures are clearly a major potential occupational health and safety issue.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY

According to the present invention there is provided a friction bolt for frictionally engaging with the internal surface of a bore drilled into rockmass, the friction bolt comprising a generally circular tube defining a longitudinal split, the tube being radially expandable, the bolt having a first distal or leading end for insertion into a bore and a second proximal end defining a head;

expander means for expanding the diameter of the tube at least one location along the tube, the means comprising first and second expander elements arranged so that relative movement of the two elements causes the diameter of the tube to expand at that location; and an elongate rod extending longitudinally into the tube one distal end of which is operatively connected to first expander element the wherein rotation of the elongate rod causes the relative movement of the two elements to cause the diameter of the tube to expand at the location, and wherein the rod includes a central portion which is wider than the proximal end of the rod;

wherein the bolt further includes an arrestor which defines an aperture which locates on the proximal end of the rod, the aperture being larger than the proximal end of the rod so that the arrestor is able to move along and move on the proximal end of the rod, and wherein the arrestor defines a laterally extending protrusion which locates in the longitudinal split and is narrower than the longitudinal split and which is configured to engage with the head of the friction bolt when moved towards the proximal end of the friction bolt.

Typically, the proximal end of the rod is externally threaded, the central portion of the rod defines a series of raised protrusions or ribs, and the distal end of the rod is externally threaded.

It is preferred that the arrestor is in the form of a ring which is mounted on the rod and which defines a circular aperture whose diameter is greater than the diameter of the proximal end of the rod but which is less than the maximum diameter of the central portion of the rod as defined by the raised protrusions.

Preferably, the head of the friction bolt defines a reinforcing ring or split ring which is fixed to and extends around the exterior of the circular tube, and wherein the protrusion extends radially away from the ring of the arrestor, locates in the longitudinal split of the tube, and is arranged to engage with the reinforcing ring so as to prevent passage of the arrestor beyond the reinforcing ring.

In a preferred embodiment a contraction is defined in the internal diameter of the tube which limits the movement of the second element towards the proximal end of the friction bolt.

Typically, the leading end of the bolt is tapered.

In a preferred embodiment, a floating ring locates on and/or around the elongate element between the head and the contraction and includes a face which is configured to seat against the contraction.

The first expander element may be in the form of a wedge which defines an internally threaded bore and wherein rotation of the elongate element/rod draws the wedge in the direction of the head of the bolt.

Preferably, the second expander element comprises a shell defining a plurality of leaves which are spaced from one another and the first expander element defines a projection, which projects outwardly from a longitudinal axis of the bolt and which locates in a longitudinal gap between two leaves of the shell to inhibit rotation of the first expander element relative to the second expander element, about the longitudinal axis. The projection may be in the form of a fin whose longitudinal axis is parallel to the longitudinal axis if the bolt.

In a preferred embodiment, the second expander element comprises a shell defining a plurality of leaves which are spaced from one another and wherein a projection is defined on the second expander element which projects outwardly from a longitudinal axis of the bolt and which locates in the longitudinal split to inhibit rotation of the second expander element relative to the tube about the longitudinal axis.

Preferably, the projection on the second expander element is in the form of a pair of fins whose longitudinal axes are parallel to the longitudinal axis if the bolt and which are located on adjacent leaves of the shell spaced by a distance approximately equal to the width of the split to prevent rotation of the assembly when actuated.

BRIEF DESCRIPTION OF DRAWINGS

A specific embodiment of the present invention will now be described, by way of example only, and with reference to the accompanying drawings in which:—

DESCRIPTION OF EMBODIMENTS

Figure 1:
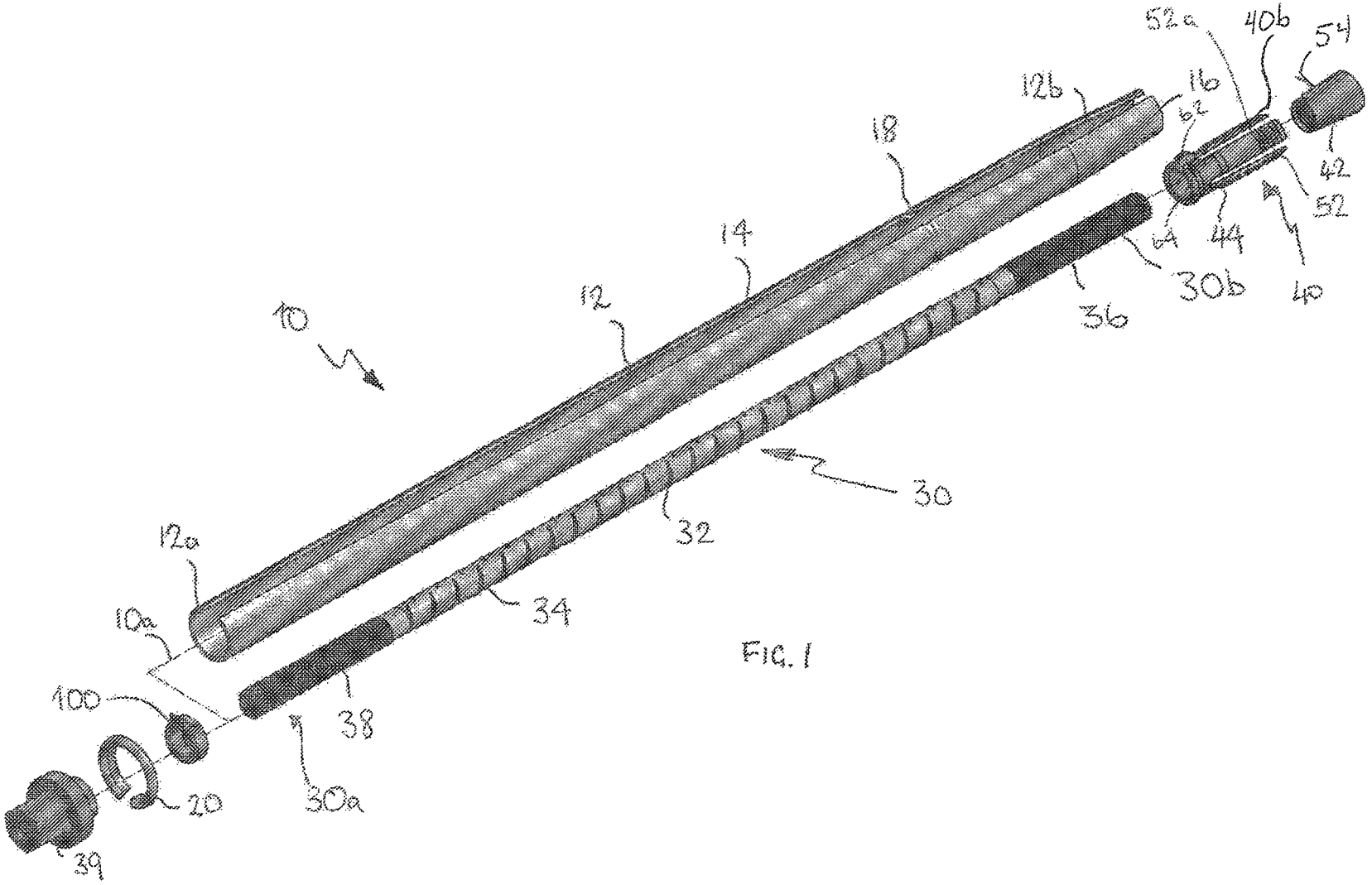
FIG. 1 is an isometric exploded view showing the components of a friction bolt embodying the present invention.

Referring to the drawings, FIG. 1 shows components of an embodiment of a friction bolt 10. As shown in FIG. 1, the bolt 10 includes an elongate tube 12 made of steel, which is typically in the order of 2 m long, but whose length can vary from 1 to 5 m depending on the particular application. A longitudinal axis 10*a* is shown extending along the centre of the tube. The tube has a head or proximal end 12*a* and a distal or leading end 12*b*. The tube 12 is split longitudinally along its length and the split is typically about 25 mm wide. The split 14 extends along the length of the tube. The tube tapers at the leading end 12*b* of the bolt. The tapered end 16 makes it easier to insert the tube into a pre-drilled bore.

Approximately 300 mm from the leading end 12*b* of the tube, there is an indent 18 which is rolled/crimped into the tube which narrows the internal diameter of the tube at that point. The indent extends around the perimeter of the tube 12. A split ring 20 having a thickness of about 5 mm is welded onto the exterior of the tube at the head end 12*a*.

FIG. 1 also shows a steel rod 30 which is typically about 2 m long. The main central portion of the rod 32 defines a series of raised ribs 34 which extend part way around the circumference of the bar. The ribs are raised by about 2 mm relative to both the underlying cylindrical surface of the rod and also are raised relative to the externally threaded portions 36 and 38 of the rod which are defined at each end of the rod. An internally threaded nut 39 is attached to the proximal end 30*a* of the rod using the threaded portion 38.

Also shown in FIG. 1, is an arrestor in the form of an energy absorbing ring 100, which freely locates over the threaded portion 38 of the rod between the ring 20 and the ribbed portion 34 of the rod, as is described in more detail below.

Figure 7:
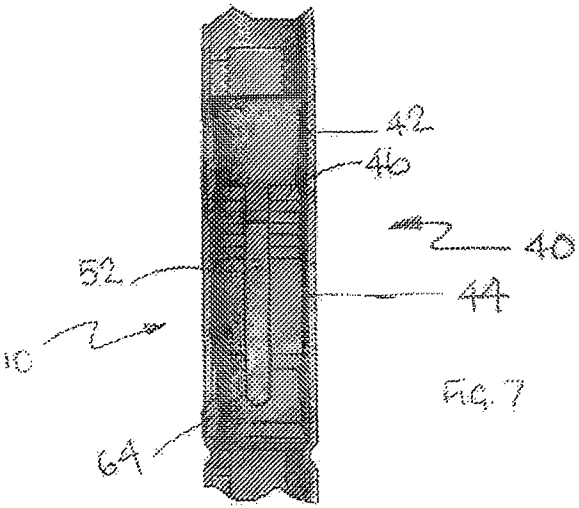
FIG. 7 in an enlarged view showing the wedge expansion elements of the friction bolt.

FIGS. 1 and 7 shows components of an expansion assembly/anchor 40. The anchor comprises a first expander element in the form of a conical wedge element 42 and a second expander element in the form of an external shell 44. The external shell comprises four leaves 46 which are generally arcuate in a cross-section transverse to the longitudinal axis of the bolt and subtend an angle of about 90°. The inner surface of the leaves 46 is smooth and part cylindrical. The external surface defines a series of ridges which, in use, engage with the internal walls of the tube 12. The thickness of the leaves gradually increases from the distal end of the leaves closest to the wedge element to the proximal end.

Longitudinal gaps 52 are defined between the leaves, three of which are closed at one end and one of which 52*a* is not. The wedge element 42 defines an external fin 54 which locates in the gap 52*a* between two adjacent leaves to prevent the wedge rotating relative to the shell. Gap 52*a* is a through gap and is not closed at the distal end 40*b* of the shell furthest from the wedge. The second expander element/shell 34 defines two fins 62 and 64 which are located at the distal end of the shell, spaced apart on either side of the through gap 52*a*.

The two fins 62 and 64 locate in the split 14 in the tube 12. The distance between the two fins is about the same/slightly larger than the width of the split 14 so that the fins help to centre and steady the position of the shell 32 in the tube 12, as well as preventing rotation of the shell 44 relative to the tube.

The wedge element 42 is generally conical and tapers towards the external shell, having a wider end and a narrower end. The wedge defines a central through hole which is internally threaded (typically an M24 thread) to engage with the externally threaded part 36 of the elongate rotatable rod 30 element or stud drive.

Figure 2:
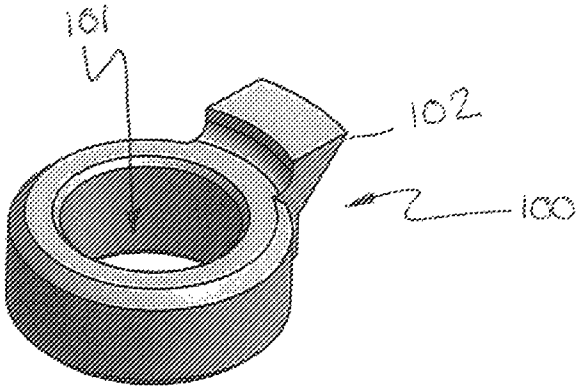
FIG. 2 is an isometric view of an energy absorbing ring of the friction bolt of FIG. 1.
Figure 3:
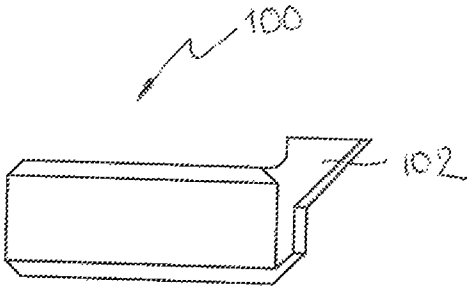
FIG. 3 is a side view of the energy absorbing ring of the shown in FIG. 2.
Figure 4:
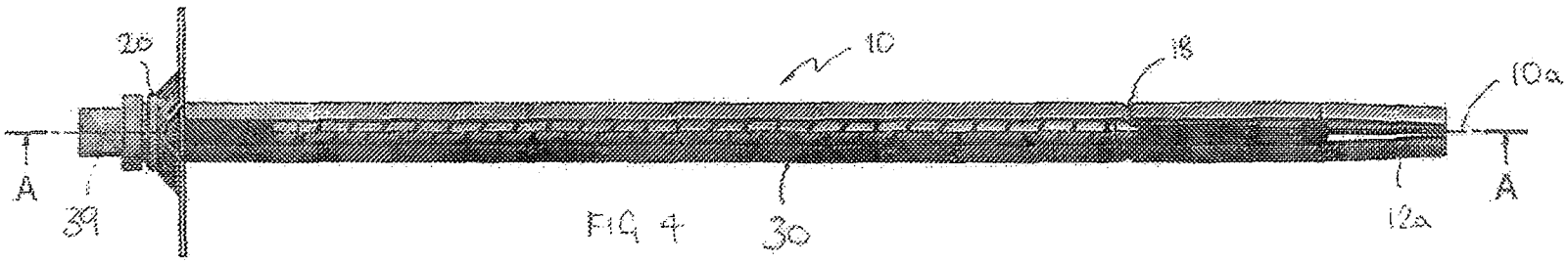
FIG. 4 is a side view of the assembled friction bolt embodying the present invention.
Figure 5:
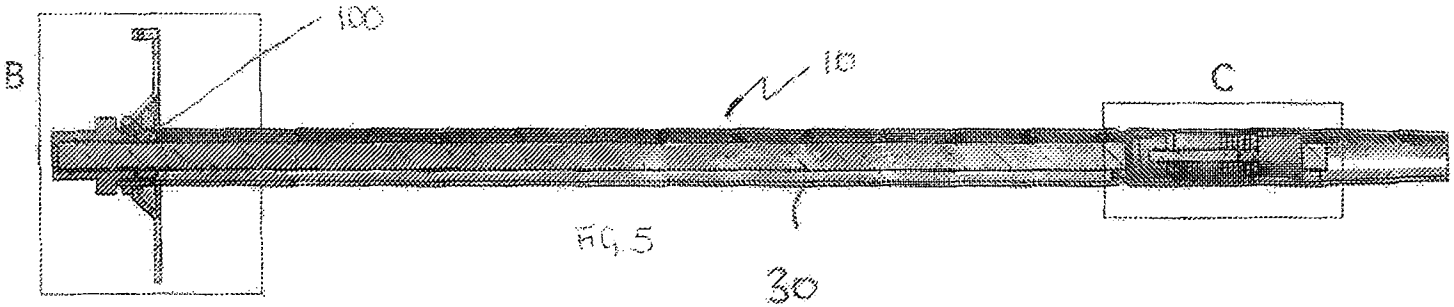
FIG. 5 is a section on A-A shown FIG. 4.
Figure 6:
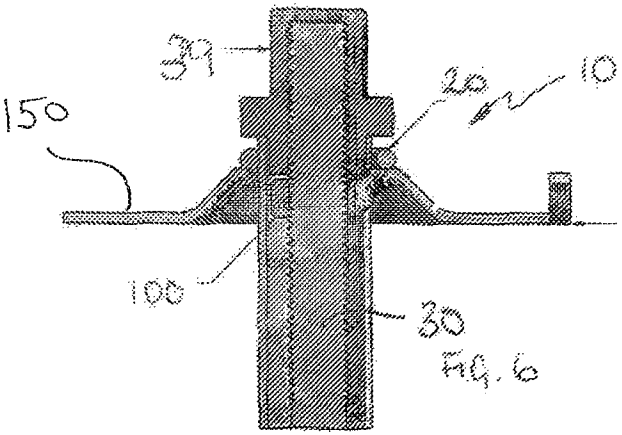
FIG. 6 is an enlarged sectional view of one end of the friction bolt shown at B in FIG. 5.

FIGS. 2 and 3 show the energy absorbing ring 100 which defines a central circular aperture 101. As shown, the energy absorbing is an annular ring having an internal diameter of about 23.7 mm and an external diameter of about 37 mm. The internal diameter of the energy absorbing ring is greater than the external diameter of the proximal threaded portion 38 of the rod so that the ring 100 can freely move/slide on that portion. The internal diameter should however be less that the maximum external thickness of the central part of the rod 32 where the ribs 34 are defined. The energy absorbing ring 100 defines a laterally and forwardly extending projection in the form of a tongue 102 which extends away from the ring. The tongue typically extends about 10 mm from the outside of the ring. With reference to FIG. 6 this ensures that the tongue does not contact and interfere with the plate 150 during installation of the friction bolt. The ring is typically made from galvanised mild steel.

Figure 8:
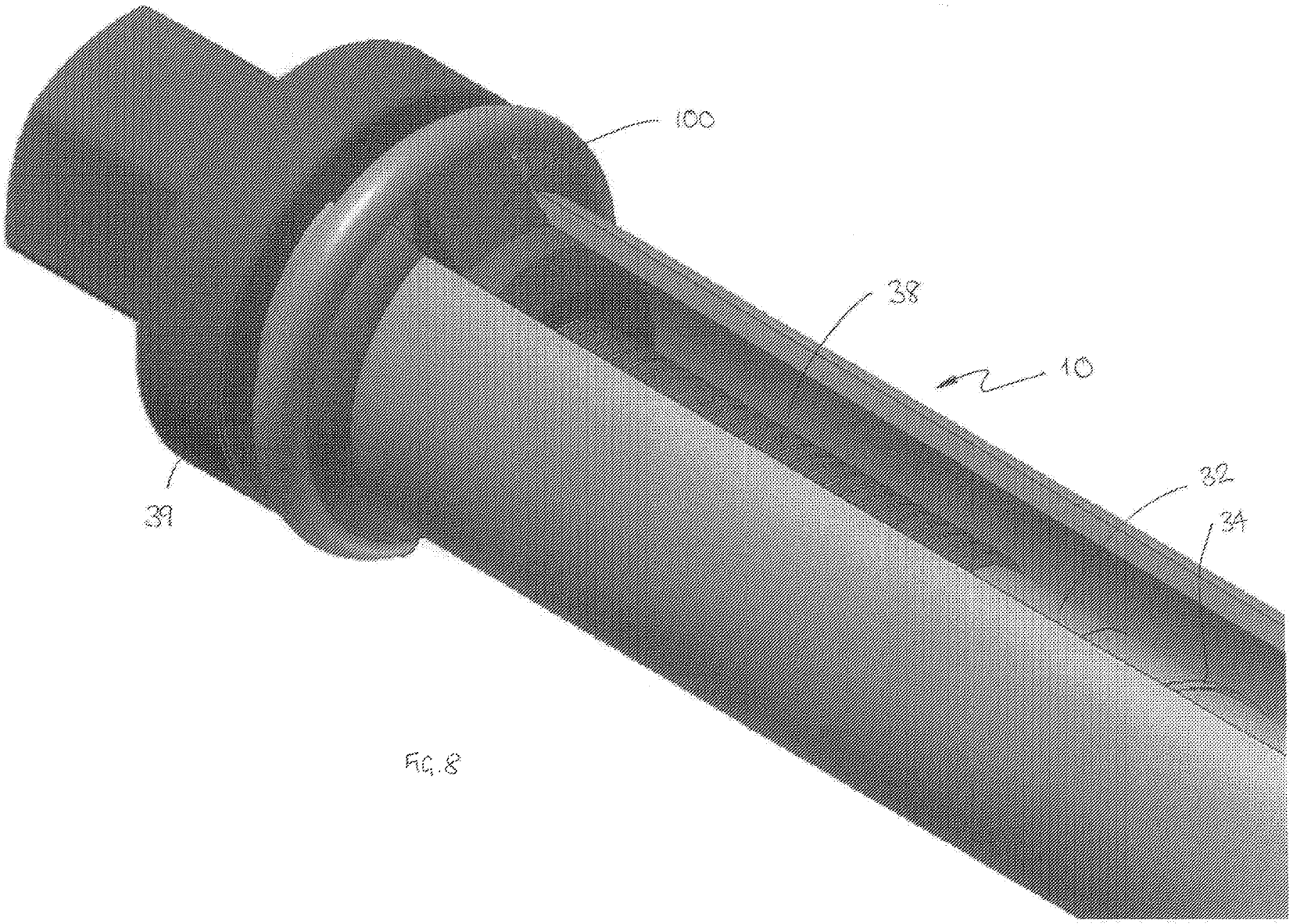
FIG. 8 is an enlarged view of the proximal end of the friction bolt.

In use, as shown in FIG. 8, the energy absorbing ring easily and freely slides over the threaded portion of the bar 38 so that it does not interfere with the installation of the friction bolt. The width of the tongue is less than the width of the slot so that the ring also does not interfere with the slot.

The components of the friction bolt are assembled as shown in FIGS. 4 to 7.

Installation of the friction bolt is unaffected by the energy absorbing ring. In use, the friction bolt is inserted in a pre-drilled hole which is marginally smaller than the external diameter of the tube. Percussion is typically used to force the friction bolt into the pre-drilled hole. Once the bolt 10 is completely installed, left hand rotation is applied to the left hand M24 thread of the rod 30. The rotating wedge 42 is drawn along the rod into the expansion shell 44, and this expansion of the shell point anchors the friction bolt 10.

In the event that the bolts become excessively stretched, having been installed in a tunnel mine which subsequently "closes in", there is a risk that the rod 30 will elongate under tension and may yield and break, failing catastrophically. As the bar breaks the proximal end of the bar is ejected from the tube 12 under tension. In this case as the bolt travels in a direction out from the tube, the raised deformations/ribs 34 are caught by the energy absorbing ring 100 and the ring is forced towards the proximal end of the bolt. When the ring reached the proximal end of the friction bolt the tongue catches against the split ring 20. The rod is held by the ring 100 which in turn is caught by the split ring 20, thus preventing ejection of the rod from within the installed bolt in the tunnel.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A friction bolt for frictionally engaging with an internal surface of a bore drilled into rockmass, the friction bolt comprising a generally circular tube defining a longitudinal split, the tube being radially expandable, the bolt having a first distal or leading end for insertion into a bore and a second proximal end defining a head, the head defining a reinforcing ring or split ring which is fixed to and extends around the exterior of the circular tube;

expander means for expanding the diameter of the tube at at least one location along the tube, the means comprising first and second expander elements arranged so that relative movement of the first and second expander elements causes the diameter of the tube to expand at that location; and an elongate rod extending longitudinally into the tube, the rod defining a proximal end and a distal end, the distal end being operatively connected to the first expander element, wherein rotation of the elongate rod causes the relative movement of the two elements to cause the diameter of the tube to expand at the location, anchoring the tube and allowing the rod to be tensioned in use, and wherein the rod includes a central portion which is wider than the proximal end of the rod;

wherein the bolt further includes a unitary arrestor ring which defines an aperture which locates on the proximal end of the rod, the aperture being larger than the proximal end of the rod, wherein the arrestor ring is configured to move along the rod proximal end and to allow the rod, which passes through the aperture, to rotate relative to the arrestor ring, the aperture being smaller than the central portion of the rod, wherein the arrestor defines a laterally extending protrusion which locates in the longitudinal split and is narrower than the longitudinal split and which is configured to engage with the head of the friction bolt when moved towards the proximal end of the friction bolt and wherein the arrangement between the friction bolt, the rod, and the arrestor ring is such that, when installed in the bore, in use, with the rod under tension, and failure of the rod under tension causes the rod to split into two with the proximal end of the rod having a tendency to eject from the bore, ejection of the proximal end of the rod is arrested by the arrestor ring which is engaged by the wider central portion as the proximal end of the rod travels, the arrestor ring is forced towards the proximal end of the friction bolt, and laterally extending protrusion of the arrestor ring impacts on and is caught by the reinforcing ring thereby inhibiting ejection of the proximal end of the rod from the bore.

2. The friction bolt as claimed in claim 1 wherein the proximal end of the rod is externally threaded, wherein the central portion of the rod defines a series of raised protrusions or ribs, and wherein the distal end of the rod is externally threaded.

3. The friction bolt as claimed in claim 2 wherein the first expander element is internally threaded and mounted on the threaded end distal end of the elongate rod the second expander element locates between the rod and the tube and is not secured to the tube; and the internal diameter of the tube is narrowed to limit the movement of the second element towards the proximal end of the friction bolt.

4. The friction bolt as claimed in claim 1, wherein the protrusion extends radially away from the ring of the arrestor, locates in the longitudinal split of the tube, and is arranged to engage with the reinforcing ring so as to prevent passage of the arrestor beyond the reinforcing ring.

5. The friction bolt as claimed in claim 4, wherein the protrusion is in the form of a tongue and extends laterally and forwardly away from the ring of the arrestor towards the proximal end of the friction bolt.

6. The friction bolt as claimed in claim 1, wherein the arrestor ring is made from steel.

* * * * *